US011053654B2

(12) United States Patent
Meling et al.

(10) Patent No.: US 11,053,654 B2
(45) Date of Patent: Jul. 6, 2021

(54) SUBSEA FOUNDATIONS

(71) Applicant: Subsea 7 Norway AS, Stavanger (NO)

(72) Inventors: Torstein Meling, Tananger (NO); Marijana Tomas, Stavanger (NO); Robert Archer, Claygate (GB)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/308,456

(22) PCT Filed: Jun. 9, 2017

(86) PCT No.: PCT/EP2017/064124

§ 371 (c)(1),
(2) Date: Dec. 7, 2018

(87) PCT Pub. No.: WO2017/212026

PCT Pub. Date: Dec. 14, 2017

(65) Prior Publication Data

US 2019/0271132 A1 Sep. 5, 2019

(30) Foreign Application Priority Data

Jun. 10, 2016 (GB) ..... 1610168

(51) Int. Cl.

| | |
|---|---|
| ***E02D 23/16*** | (2006.01) |
| ***E02D 27/52*** | (2006.01) |
| ***E02D 27/12*** | (2006.01) |

(52) U.S. Cl.
CPC ..... *E02D 23/16* (2013.01); *E02D 27/12* (2013.01); *E02D 27/52* (2013.01)

(58) Field of Classification Search
CPC ..... E02D 23/00; E02D 23/16; E02D 25/00; E02D 27/12; E02D 27/52; E02D 27/525; E02D 13/04; E21B 41/08; E02B 17/027; B63B 21/50
See application file for complete search history.

(56) References Cited

U.S. PATENT DOCUMENTS

| | | | | |
|---|---|---|---|---|
| 3,832,858 A | | 9/1974 | Anders | |
| 4,580,926 A | * | 4/1986 | Bunnell | E02B 17/00 405/195.1 |
| 4,822,212 A | * | 4/1989 | Hall | E21B 33/043 405/227 |
| 4,830,542 A | * | 5/1989 | Bunnell | E21B 43/017 175/7 |

(Continued)

FOREIGN PATENT DOCUMENTS

| | | |
|---|---|---|
| DE | 102008000382 | 9/2009 |
| FR | 2 922 563 | 4/2009 |

(Continued)

*Primary Examiner* — Benjamin F Fiorello
*Assistant Examiner* — Stacy N Lawson
(74) *Attorney, Agent, or Firm* — Levy & Grandinetti

(57) ABSTRACT

A subsea foundation for supporting a pipeline or a pipeline accessory has a mudmat and at least one pile arranged to anchor the mudmat by extending from the mudmat into seabed soil. A coupling that couples the pile to the mudmat has at least one interface member supported for angular displacement relative to the mudmat, such as a pivoting beam or a wedge-shaped adaptor ring, to accommodate the orientation of the mudmat relative to the pile.

16 Claims, 5 Drawing Sheets

(56) References Cited

U.S. PATENT DOCUMENTS

| | | | | |
|---|---|---|---|---|
| 8,025,463 | B2 | 9/2011 | Foo et al. | |
| 2012/0301226 | A1* | 11/2012 | Mack | E02D 13/04 405/228 |
| 2014/0014021 | A1* | 1/2014 | Tomas | B63B 21/24 114/294 |
| 2014/0056649 | A1* | 2/2014 | Berry | E02D 13/04 405/232 |
| 2015/0125220 | A1* | 5/2015 | Glukhovskoy | E02D 27/12 405/227 |
| 2015/0284927 | A1* | 10/2015 | Gunter | E02D 7/02 405/232 |
| 2016/0002875 | A1* | 1/2016 | Gunter | E02D 13/04 405/232 |
| 2019/0048551 | A1* | 2/2019 | Boot | E02D 13/005 |

FOREIGN PATENT DOCUMENTS

| | | |
|---|---|---|
| GB | 1 303 614 | 1/1973 |
| GB | 1 503 398 | 3/1978 |
| GB | 2 090 314 | 7/1982 |
| GB | 2 192 923 | 1/1988 |
| GB | 2 211 526 | 7/1989 |
| GB | 2467842 | 8/2010 |
| GB | 2496468 | 5/2013 |
| WO | WO 2012/143697 | 10/2012 |

* cited by examiner

SUBSEA FOUNDATIONS

BACKGROUND OF THE INVENTION

This invention relates to subsea foundations for structures placed on the seabed, such as pipeline accessories or other large subsea structures as used in the subsea oil and gas industry.

Conventional subsea foundations are of two main types, namely mat foundations and pile foundations.

Mat foundations, typically known in the art as mudmats, are generally flat and are designed to lie on the seabed in a substantially horizontal plane to spread the weight load that they carry in use. In contrast, piles are generally cylindrical and are elongated vertically to be buried deeply in the seabed soil, in a substantially vertical orientation.

Mudmats can be designed to slide horizontally across the seabed, for example to accommodate thermal elongation of a supported pipeline due to temperature fluctuations between operation and shut-down. Alternatively, mudmats can be designed to remain substantially static on the seabed, for example by adding a shallow peripheral skirt that embeds into and engages with the seabed soil. Piles are invariably designed to resist any horizontal movement across the seabed, although they may be surmounted by a docking system that allows for some horizontal movement of the structure being supported.

Mudmats are often preferred as foundations for pipeline accessories because their substantial horizontal area can accommodate a greater tolerance in the position of a subsequently-laid pipeline. As the horizontal extent of a pile foundation is smaller than that of a mudmat, pile foundations are less tolerant of any positional mismatch between the pipeline and the foundation. However, a mudmat would have to be extremely large to bear the weight of larger subsea structures, even of some large pipeline accessories. In such circumstances, it may be preferred to install several piles and to provide a docking and levelling system to couple with the structure.

Both mat foundations and pile foundations require a large amount of steel for their construction, which adds to their cost and to the challenges of installing them. In particular, large mudmats are challenging to lower into the sea through a turbulent splash zone near the surface. Large mudmats also tend to make inefficient use of their full contact area if they are installed on an uneven seabed.

In view of these disadvantages, hybrid foundations are known that combine mat and pile technology to enable a smaller mudmat to be used with fewer and/or smaller piles. The mudmat provides some bearing surface; the piles provide an additional bearing surface to compensate for the reduced size of the mudmat. For example, U.S. Pat. No. 8,025,463 describes a hybrid foundation comprising a mudmat and embedded suction piles.

As the installation of suction piles is time-consuming, gravity or pin piles may be preferred. A pin pile is installed by being embedded into the seabed soil under additional static weight, for example as disclosed in U.S. Pat. No. 3,832,858, or by being driven into the seabed soil by a hammer-type subsea pile driver. Another example of a pinned mat is disclosed in GB 2192923, where mudmats that support the weight of an offshore platform jacket are pinned into the seabed soil by guiding piles through funnels and guide tubes to intersect the general plane of the mudmat.

A drawback of the arrangement disclosed in GB 2192923 is that the orientation of the piles relative to the mudmat is guided by the guide tubes to be strictly perpendicular to the general plane of the mudmat. This is not a concern if the seabed is horizontal. However, if the seabed slopes away from the horizontal, installation of piles can be problematic because the natural tendency of a pile is to penetrate seabed soil vertically under its self-weight. Consequently, piles installed on a non-vertical installation axis tend to deviate from that installation axis toward the vertical.

Thus, when a mudmat like that disclosed in GB 2192923 and the underlying seabed are not horizontal and the guide tubes of that mudmat are therefore not vertical, it is impractical to rely solely upon self-penetration of the piles. Instead, non-vertical penetration of the piles has to be forced by hammering, for pin piles, or by suction, for suction piles.

Hammering or suction operations require additional equipment to be deployed underwater, which increases technical difficulty and cost. For example, a typical subsea pile-driving hammer is a large and heavy tool, more than 5 m high. Hammering or suction operations also take time and must be repeated for each successive pile. In particular, as suction is applied after a period of self-penetration, installation of a pile involving suction will, typically, take longer than relying simply upon self-penetration.

FR 2922563 suggests using circular wedges to tilt or level a subsea structure relative to a foundation, in that example a suction pile that has the disadvantages described above. A support of the structure is coupled to the top of the suction pile via a tilting mechanism situated on top of the pile. The structure supported by the foundation is not a mat and so is not itself a part of the foundation. Consequently, there is no need for angle compliance between the structure and the slope of the seabed. To the contrary, the inclination of the structure, which lies clear of the seabed, is adjusted to be horizontal. Also, the suction pile of FR 2922563 is necessarily installed before the structure that will be supported on the pile, whereas a pinned mudmat like that disclosed in GB 2192923 is typically placed on the seabed before installing the piles that cooperate with it.

In GB 1503398, a bowl-shaped interface allows a flat guide base that lies on an inclined seabed to be tilted relative to a substantially vertical drilling conductor. However, the drilling conductor and the guide base do not define a foundation that is capable of supporting the weight of a heavy subsea structure. Also, such a solution provides no means to guide a pin pile and to lock it to the base.

The present invention arose from the need to support a large subsea structure on soft clay seabed soil, the accessory in that case being a pipeline accessory in the form of a PLET (pipeline end terminal) for a large-diameter pipeline. Supporting the weight of such a large PLET and the attached spool pipe on such soil required the use of a hybrid foundation comprising a mudmat supplemented by piles at the periphery of the mudmat.

Foundation analysis showed that it was preferable for the piles to be locked to the mudmat to provide the necessary support for the PLET and the spool. However, existing pile-locking techniques were found to be either too expensive or too time-consuming to be adopted. It was therefore necessary to design and fabricate an alternative method of locking the piles, while satisfying a requirement to allow for seabed slopes of up to, say, 5° to 10° in any direction.

An example of an unsuitable pile locking technique is described in GB 2211526, which discloses a seabed template for installing vertical well casings. The template includes a mudmat that is secured to the seabed by piles that are coupled to the template by spherical bearing connectors. Once a pile is installed, a portion of the pile residing within an annular groove of the respective connector is radially expanded, to lock the pile against axial movement relative to its connector.

As GB 2211526 does not relate to a foundation for supporting a pipeline or a pipeline accessory, it is not directly relevant to the above problems associated with providing such support.

Thus, the invention proposes solutions to accommodate pinned mudmats on sloping seabeds.

BRIEF SUMMARY OF THE INVENTION

In one sense, the invention resides in a subsea foundation for supporting a pipeline or a pipeline accessory, the foundation comprising: a mudmat; at least one pile arranged to anchor the mudmat in use by extending with a relative orientation from the mudmat into seabed soil; and a coupling that couples the pile to the mudmat, the coupling comprising at least one interface member supported for angular displacement relative to the mudmat to accommodate the orientation of the mudmat relative to the pile. The foundation is suitable for supporting pipelines or pipeline accessories attached to pipelines that are generally horizontal, or at least substantially parallel to the seabed.

Conveniently, the interface member may be supported by the pile for angular displacement relative to the pile. In that case, a yaw pivot may act between the pile and the interface member, the yaw pivot being oriented to permit angular movement of the interface member about a central longitudinal axis of the pile. Preferably, the yaw pivot is located within the pile.

A roll/pitch pivot may also act between the pile and the interface member, the roll/pitch pivot being oriented to permit angular movement of the interface member about a transverse axis substantially orthogonal to a central longitudinal axis of the pile. Again, preferably, the roll/pitch pivot is located within the pile.

The interface member suitably extends laterally from the pile. For example, the interface member may be a beam that extends through the pile and protrudes radially from apertures in the pile.

The coupling may comprise a guide sleeve around the pile, leaving a gap between the pile and the guide sleeve. The pile is suitably supported laterally within the guide sleeve by at least one shim in the gap.

Where there is a gap between the pile and the surrounding sleeve, the interface member preferably bridges the gap to be received in a receptacle of the guide sleeve. Such a receptacle can provide clearance around the interface member received therein for angular displacement of the interface member relative to the mudmat. For ease of insertion of the interface member on installing the pile, the receptacle is advantageously open-topped. Preferably, the interface member is fastened to the guide sleeve or otherwise to the mudmat to lock the pile to the mudmat.

In some embodiments, the interface member comprises a wedge-shaped adaptor ring disposed between a guide tube and the mudmat, the adaptor ring being positionable at various angular positions relative to the mudmat. It is also possible for the guide tube to be wedge-shaped and to be positionable at various angular positions relative to the adaptor ring.

The inventive concept embraces a related method of installing a subsea foundation for supporting a pipeline or a pipeline accessory. That method comprises installing a mudmat at a seabed location and subsequently anchoring the mudmat by installing at least one pile that extends with a relative orientation from the mudmat into seabed soil and is coupled to the mudmat. The method further comprises effecting angular displacement of an interface member relative to the mudmat to accommodate the orientation of the mudmat relative to the pile. Preferably, the pile is locked to the mudmat, conveniently via the interface member.

There may be angular displacement of the interface member relative to the pile. For example, there may be yaw displacement of the interface member about a central longitudinal axis of the pile. It is also possible to have pitch or roll displacement of the interface member about a transverse axis substantially orthogonal to a central longitudinal axis of the pile.

The pile may be inserted into a guide sleeve of the mudmat, while leaving a gap between the pile and the guide sleeve. That gap can be bridged by the interface member.

The interface member can be engaged with a receptacle as the pile is installed and coupled to the mudmat. Preferably, the interface member enters the receptacle in a downward direction. Yaw displacement of the interface member with respect to the receptacle may take place before the interface member is engaged with the receptacle.

Pitch or roll displacement of the interface member may take place when the interface member is engaged with the receptacle. For example, pitch or roll displacement of the interface member may take place within and relative to the receptacle when the interface member is engaged with the receptacle.

In summary, preferred embodiments of the invention provide a foundation for a subsea structure, which structure may, for example, be a pipeline lifting frame or an accessory permanently connected to a pipeline. The foundation comprises at least one mudmat, at least one pile for anchoring the mudmat, and an interface system between the mudmat and the or each pile. The interface system allows tilting of the or each pile relative to the mudmat. For example, the mat may adopt a slope of greater than 2° with respect to a horizontal plane, while the or each pile remains substantially vertical.

The pile suitably extends through a hole, socket or sleeve provided in, or fixed to, the mudmat. This provides a slot or receptacle for receiving a pile after the mudmat has been placed on the seabed, to pin the mudmat to the seabed.

The number and arrangement of piles that cooperate with the mudmat can be adjusted depending on the nature of the seabed soil. For example, the mudmat could comprise spare slots for more piles than are needed for a particular installation site.

In one embodiment of the invention, the interface system comprises a guide tube whose internal diameter is slightly greater than the outer diameter of the pile. A rotational wedge between the guide tube and the mudmat can be turned around a substantially vertical axis to vary the angle of the guide tube relative to the mudmat. This allows the guide tube to accommodate differences in orientation of the pile relative to the mudmat.

In another embodiment of the invention, the interface system also comprises a guide tube or sleeve whose internal diameter is slightly greater than the outer diameter of the pile. In this case, the guide tube remains perpendicular to the general plane of the mat. The guide tube comprises a pile locking mechanism, which may comprise a transverse pin, and one or more inner pivot shims that allow variations in the angle of the pile relative to the guide tube by tilting the pile around at least one horizontal axis.

The pile locking mechanism may provide two degrees of freedom to comply with various orientations of the pile relative to the mat. For example, the pile locking mechanism may be able to rotate around a vertical axis and at least one horizontal axis. Conveniently, the pile locking mechanism may be built in to the pile.

BRIEF DESCRIPTION OF THE DRAWINGS

In order that the invention may be more readily understood, reference will now be made, by way of example, to the accompanying drawings, in which.

DETAILED DESCRIPTION OF THE INVENTION

Figure 1:
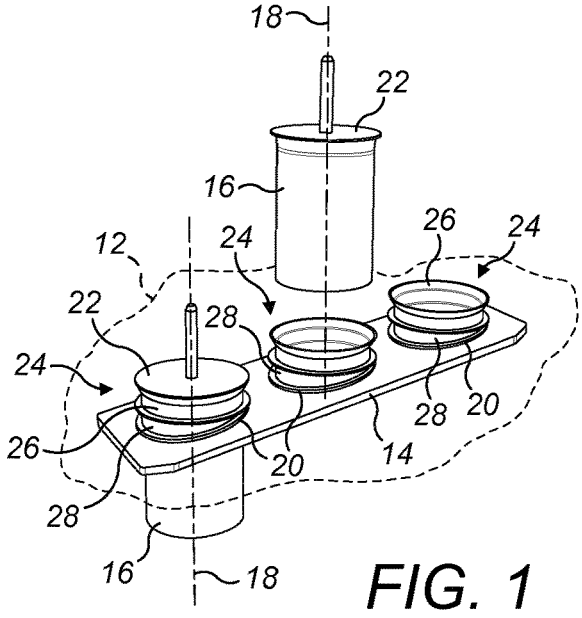
FIG. 1 is a schematic perspective view of a hybrid foundation in accordance with the invention, comprising a mudmat and piles intersecting the general plane of the mudmat at acute angles to pin the mudmat to an inclined seabed.

Referring firstly to FIG. 1 of the drawings, a hybrid foundation 10 in accordance with the invention is shown in the process of being installed on an inclined seabed 12. The foundation 10 comprises a generally planar mudmat 14 and elongate cylindrical piles 16 whose central longitudinal axes 18 intersect the general plane of the mudmat 14 at similar acute angles. In this simplified example, the mudmat 14 is oblong and the piles 16 are aligned in a straight array, spaced along a longitudinal axis of the oblong mudmat 14. The piles 16 extend through respective openings 20 that penetrate the mudmat 14 or are otherwise in fixed relation to the mudmat 14.

The piles 16 may be suction piles or may be pin piles installed by self-weight and/or by being hammered into the seabed 12. Each pile 16 is surmounted by a cap 22 that is wider than the main body of the pile 16. This requires the piles 16 to be inserted through respective openings 20 in the mudmat 14 after the mudmat 14 has been placed on the seabed.

FIG. 1 shows: a first pile 16 already in place, fully inserted through a first opening 20 of the mudmat 14; a second pile 16 aligned with and being lowered into a second opening 20 of the mudmat 14; and a third opening 20 of the mudmat 14 awaiting another pile that is not shown.

Each opening 20 is surrounded and surmounted by a respective tubular guide sleeve 24. Each guide sleeve 24 is topped with a guide tube that, in this example, is a funnel 26 that splays outwardly and upwardly to receive a pile 16 being lowered into engagement with the pre-installed mudmat 14, like the second pile of FIG. 1. The funnel 26 then guides the pile 16 into and through the associated opening 20 in the mudmat 14. When a pile 16 is inserted fully, like the first pile 16 of FIG. 1, the cap 22 atop the pile 16 seats onto or into a respective one of the funnels 26.

There is no provision for locking the piles 16 to the mudmat 14 in this simplified example. The mudmat 14 is simply sandwiched between the caps 22 of the piles 16 and the seabed, so that locating forces bear down on the mudmat 14 arising from the weight of, or tension in, the piles 16. However, a locking interface between the piles 16 and the guide sleeves 24 could be provided, for example between a cap 22 and an underlying or surrounding funnel 26.

In the example shown in FIG. 1, the central longitudinal axes 18 of the piles 16 are parallel and vertical but the mudmat 14 is inclined away from a horizontal axis, as will be the case if the foundation 10 is used on a sloped seabed. The mudmat 14 may be regarded as having experienced pitch about its transverse axis and/or roll about its longitudinal axis. Thus, the central longitudinal axes 18 of the piles 16 are at acute angles to the general plane of the mudmat 14.

The guide sleeves 24 are adapted to accommodate this non-orthogonal relationship between the axes 18 of the piles 16 and the general plane of the mudmat 14. For this purpose, each guide sleeve 24 has an adaptor ring 28 between the funnel 26 and the associated opening 20 in the mudmat 14. Flanged joints join the adaptor ring 28 to the funnel 26 and to the mudmat 14 around the opening 20.

Each adaptor ring 28 is wedge-shaped in side view, comprising a circular planar upper surface and an elliptical planar lower surface whose plane converges with or intersects the plane of the upper surface. In this example, the upper and lower surfaces of the adaptor ring 28 are defined by upper and lower flanges respectively. The plane of the upper surface is substantially horizontal. The plane of the lower surface is non-horizontal, substantially to match the inclination of the mudmat 14 relative to the horizontal.

It will be apparent that turning an adaptor ring 28 relative to the mudmat 14 will orient the associated guide sleeve 24 to align with a pile 16 whose central longitudinal axis 18 may adopt various angles with respect to the plane of the mudmat 14. The adaptor ring 28 may be turned to an appropriate angular position and then fixed to the mudmat 14 before or during installation of the foundation 10. The openings 20 are made wide enough to accommodate various possible orientations of the piles 16.

Figure 2:
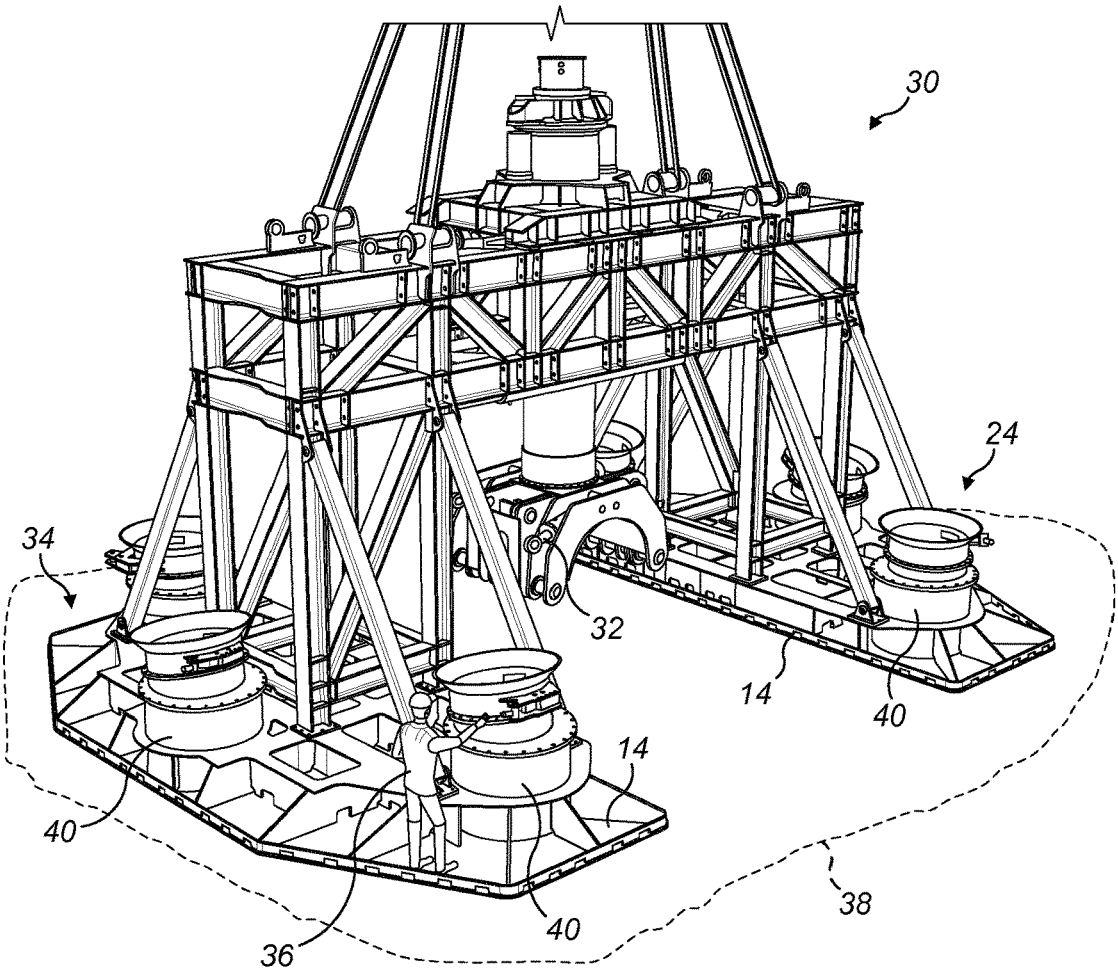
FIGS. 2 and 3 are perspective view of a pipe lifting and alignment frame comprising hybrid foundations that share the principles of the foundation shown in FIG. 1, FIG. 3 showing piles at various acute angles to the general plane of associated mudmats.
Figure 3:
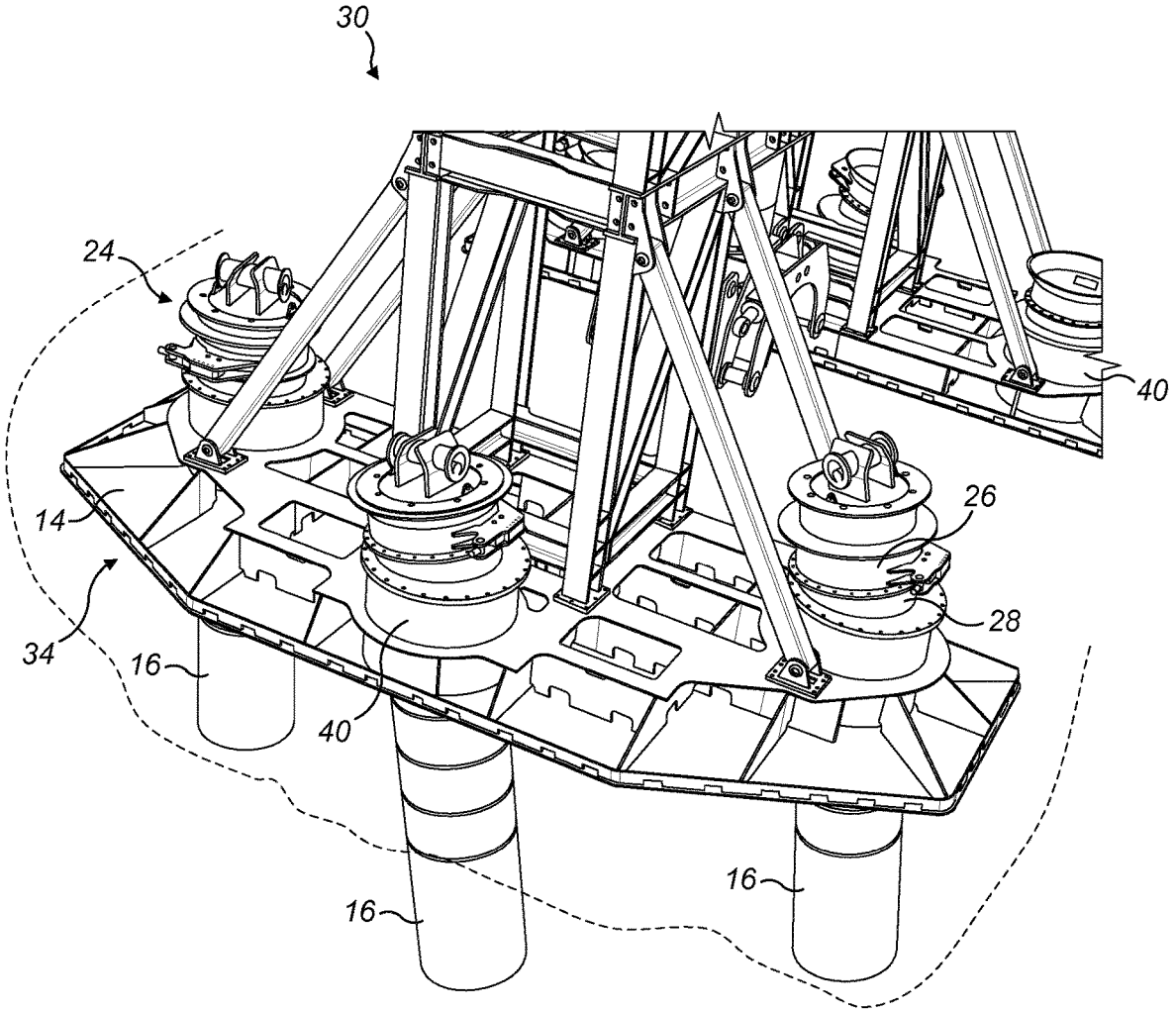

FIGS. 2 and 3 show a practical application of the hybrid foundation 10 shown in FIG. 1. Like numerals are used for like parts. In this example, a frame 30 for pipe lifting and alignment is a bridge-like steel structure that supports a hydraulically-powered lifting apparatus 32, providing for movement of a pipeline (not shown) in transverse and axial directions. Two hybrid foundations 34 serve as feet for the frame 30, one at each end of the frame 30. Like the simplified foundation 10 shown in FIG. 1, each foundation 34 comprises a mudmat 14 that is arranged to be pinned with piles 16 once on the seabed 12.

The large scale of the frame 30 is apparent from a comparison with the image of a worker 36 also included in FIG. 2, which shows the frame 30 without piles 16 about to be lifted from a deck 38 of a surface vessel into the sea before being lowered to the seabed 12. Once the frame 30 has been landed on the seabed 12 as shown in FIG. 3, piles 16 are installed through the mudmats 12 to complete the foundations 34.

In general layout, each foundation 34 is similar to the simplified foundation 10 shown in FIG. 1, comprising a flat-bottomed mudmat 14 with three openings 20 whereby each mudmat 14 may be penetrated by three piles 16 as shown in FIG. 3. In this example, however, the openings 20 and hence the piles 16 of each foundation 34 are not aligned in a straight array. Instead, the central opening 20 and pile 16 are offset outboard of the other two openings 20 and piles 16 to accommodate the bridge part of the frame 30 that extends between the foundations 34 to supports the lifting apparatus 32. Also, the openings 20 are defined by upstanding tubular supports 40 that are integral with the mudmats 14. Guide sleeves 24, each comprising a funnel 26 and an adaptor ring 28 like those of FIG. 1, are mounted on top of the tubular supports 40.

The invention allows a pipe lifting and alignment frame 30 to be used with a wide range of seabed soil types, both sand and clay, and also on an inclined seabed presenting, say, a 5° roll and 10° pitch scenario. The arrangement shown in FIGS. 2 and 3 provides a modular system that combines fully-plated mudmats 14 that are apt for a seabed 12 of sand and suction anchors or piles 16 that are apt for a seabed 12 of clay, with the adaptor rings 28 catering for pitch and roll scenarios. The adaptor rings 28 ensure that suction anchors or piles 16 can be installed substantially vertically and that the piles 16 are able to endure horizontal loading, vertical loading and overturning moments.

The modular system of the invention reduces the mudmat area by up to 75% in comparison with conventional mudmat solutions for pipeline lifting frames. This eases lowering the frame 30 through the splash zone and makes better use of the full contact area of the mudmats 14, even if the seabed 12 is uneven.

Moving on now to FIGS. 4 to 9, these drawings illustrate a second, preferred embodiment of the invention that is apt to be used with self-penetrating piles or with piles that are driven, either using a hammer or a stationary clump weight. This embodiment also makes provision for locking the piles 16, once installed, relative to the mudmat 14. Again, like numerals are used for like parts.

Figure 4:
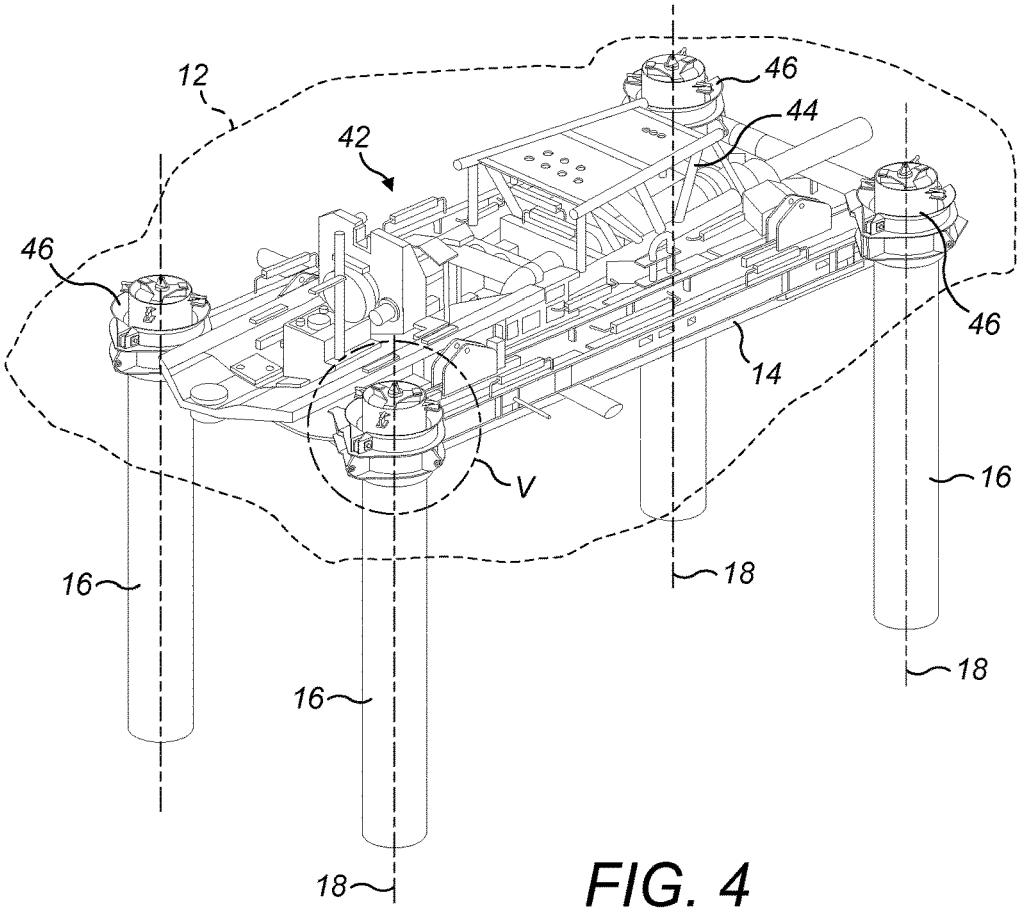
FIG. 4 is a perspective view of a PLET supported by a hybrid foundation in a preferred embodiment of the invention, the foundation comprising a mudmat and piles that can adopt a range of acute angles with respect to the general plane of the mudmat.

FIG. 4 shows a hybrid foundation 42 installed on the seabed 12, again comprising a generally planar mudmat 14 and piles 16 whose central longitudinal axes 18 intersect the plane of the mudmat 14. In this example, the mudmat 14 supports a PLET 44 and a pile 16 is situated at each corner of the oblong mudmat 14. The piles 16 extend through respective tubular pile sleeves 46 that are cantilevered outwardly from the corners of the mudmat 14, but could instead be incorporated within the mudmat 14. The tubular curvature of each pile sleeve 46 is centred on an axis that is orthogonal to the general plane of the mudmat.

Figure 5:
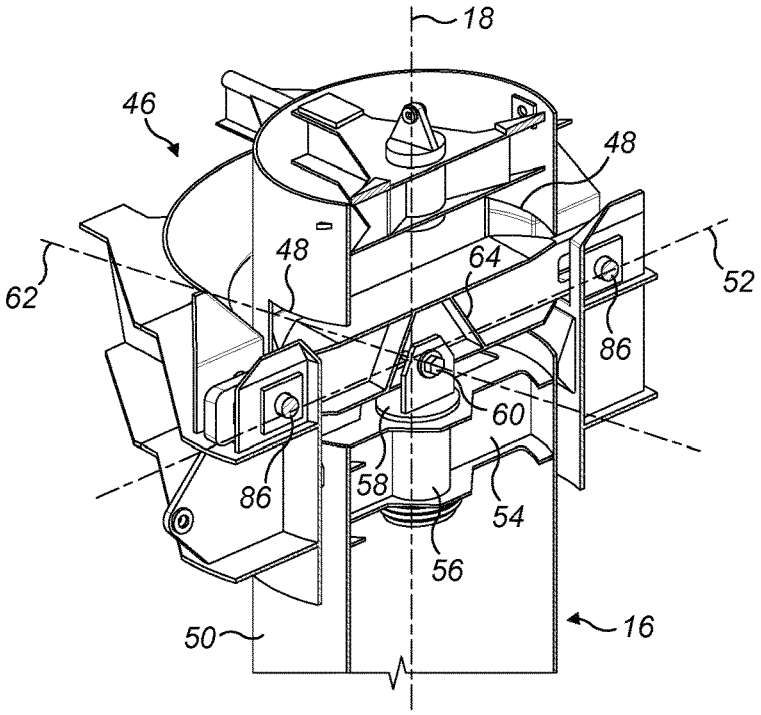
FIG. 5 is an enlarged part-sectional detail perspective view corresponding to Detail V of FIG. 4, showing the interface between a pile sleeve fixed to the mudmat of the foundation and a pile extending through the sleeve.

Each pile sleeve 46 forms part of a coupling or interface between the mudmat 14 and the respective pile 16. In this respect, FIG. 5 shows the interface between a pile 16 and a respective one of the pile sleeves 46, as a part-sectioned enlargement of Detail V in FIG. 4. For maximum clarity, FIGS. 6 and 7 show the pile 16 and the pile sleeve 46 individually and to similar scale.

Figure 6:
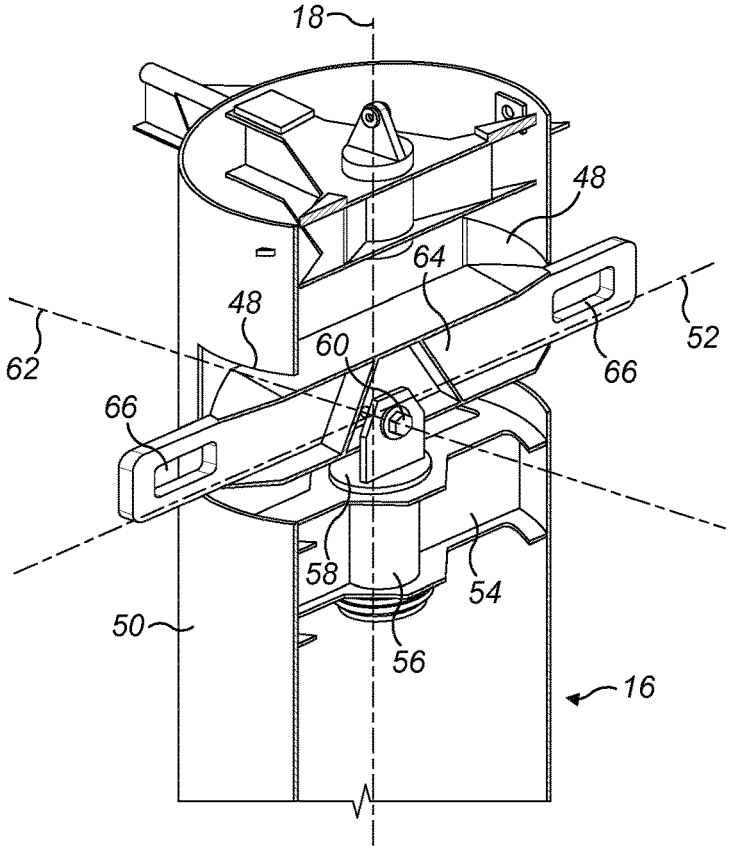
FIG. 6 is a part-sectional detail perspective view of the pile shown in FIG. 5.
Figure 7:
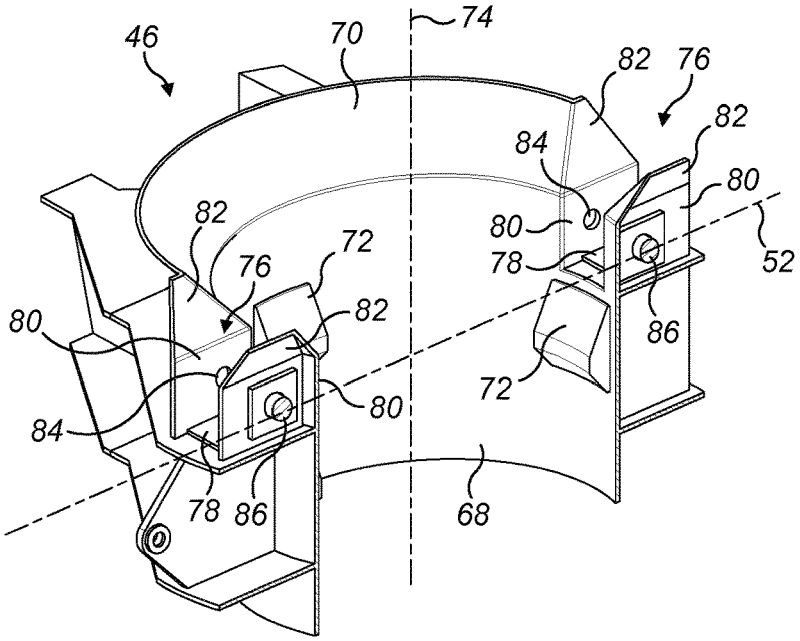
FIG. 7 is a part-sectional detail perspective view of the pile sleeve shown in FIG. 5.

With reference to FIGS. 5 and 6, the pile 16 is a hollow steel tube that accommodates and supports parts of an interface system of the invention. The pile 16 is adapted by the provision of diametrically-opposed apertures 48 near a top end of the pile 16 that penetrate the tubular wall 50. The apertures 48 together define a cross-passage extending across the full width of the pile 16. The cross-passage contains a roll axis 52 intersecting, and extending orthogonally to, the central longitudinal axis 18 of the pile 16.

A mount beam 54 is fixed within the pile 16 beneath the apertures 48. The mount beam 54 bridges the internal diameter of the pile 16, extending from one side of the tubular wall 50 to the other, diametrically opposed side. The mount beam 54 has a central tubular bearing 56 that supports a rotation block 58. The rotation block 58 can turn within the bearing 56 about the central longitudinal axis 18 of the pile 16.

An upper end of the rotation block 58 forms a pivot mounting 60 that defines a pitch axis 62 extending orthogonally to the central longitudinal axis 18 and the roll axis 52. The pivot mounting 60 supports an articulated yoke beam 64 that is centred on the pitch axis 62 and that extends parallel to the roll axis 52 along the cross-passage between the apertures 48.

The roll and pitch axes 52, 62 are interchangeable depending upon the shape and orientation of the mudmat 14 and the orientation of the interface relative to the mudmat 14. The pivot mounting 60 may therefore be regarded as a roll/pitch pivot for the yoke beam 64, although its role in defining the pitch axis 62 will be used in this description for clarity. The rotation block 58 provides a yaw pivot for the yoke beam 64.

Opposed end portions of the yoke beam 64 extend through the apertures 48 to protrude externally in opposed radial directions beyond the tubular wall 50 of the pile 16. A FIG. 6 shows, the end portions of the yoke beam 64 are penetrated by slots 66 that also extend parallel to the roll axis 54.

The combined effect of the rotation block 58 and the pivot mounting 60 is that the yoke beam 64 can pivot with a rocker motion about the pitch axis 62 to accommodate variations in pitch, and can turn about the central longitudinal axis 18 to accommodate variations in yaw or heading. The apertures 48 are enlarged relative to the thickness of the yoke beam 64 to give clearance for these movements of the yoke beam 64 relative to the tubular wall 50 of the pile 16.

With reference now to FIGS. 5 and 7, the pile sleeve 46 comprises a tubular body 68 surmounted by a guide cone 70. Like the funnel 26 of the first embodiment, the guide cone 70 splays upwardly and outwardly to guide the insertion of a pile 16.

When a pile 16 is installed through the pile sleeve 46 as shown in FIGS. 4 and 5, the pile 16 lies generally concentrically within the pile sleeve 46. The pile sleeve 46 provides clearance around the pile 16 for angular variation of the pile 16 relative to the mudmat 14. Shims 72 distributed around a central axis 74 of the pile sleeve 46, in this example four shims at 90° spacing around the interior of the tubular body 68, centralise the pile 16 within the pile sleeve 46. The shims 72 also allow the pile 16 to be driven along its central longitudinal axis 18 using a hammer or a stationary clump weight if required.

The pile sleeve 46 defines other parts of an interface system of the invention. Specifically, the guide cone 70 is interrupted circumferentially by diametrically-opposed, upwardly-opening receptacles 76 that extend downwardly into the tubular body 68 of the pile sleeve 46. Otherwise, internally, the tubular body 68 and the guide cone 70 are rotationally symmetrical about the common central axis 74 of the pile sleeve 46.

The receptacles 76 align with each other on a diameter of the pile sleeve 46 to accommodate the opposed end portions of the yoke beam 64 that extend through the apertures 48 in the tubular wall 50 of the pile 16. Each recess 76 has a flat base wall 78, parallel flat side walls 80 that extend orthogonally with respect to the base wall 78 and guide formations 82 that surmount the side walls 78.

The base walls 78 define bearing surfaces that lie in a common plane extending orthogonally to the central axis 74. The side walls 80 join the tubular body 68 and are penetrated by mutually-aligned holes 84. The guide formations 82 splay upwardly away from each other and join the guide cone 70.

As each pile 16 is driven into the seabed 12 and so advances relative to the mudmat 14 along the central longitudinal axis 18, end portions of the yoke beam 64 protruding from the pile 16 approach the pile sleeve 46. Eventually the end portions of the yoke beam 64 enter the receptacles 76 in the pile sleeve 46 through the open tops of the receptacles 76, guided in by the downwardly-converging guide formations 82. In the event of misalignment between the receptacles 76 and the yoke beam 64 in yaw or heading, the yoke beam 64 is able to pivot relative to the pile 16 about the central longitudinal axis 18. This is by virtue of the tubular bearing 56 that supports the rotation block 58 for movement relative to the mount beam 54 within the pile 16.

Downward movement of the pile 16 relative to the mudmat 14 ceases when the end portions of the yoke beam 64 rest on the base walls 78 of the receptacles 76. Locking pins 86 are then inserted through the holes 84 in the side walls 80 of the recesses 74, as best appreciated in FIG. 5, to extend through the slots 66 that penetrate the end portions of the yoke beam 64. Vertical loading is transferred to the locking pins 86 while horizontal loading is restrained primarily by the shims 72 between the pile 16 and the tubular body 66 of the pile sleeve 46.

Clearance is maintained between the end portions of the yoke beam 64 and the side walls 80 of the receptacles 76. Clearance is also maintained between the locking pins 86 and the slots 66 in the end portions of the yoke beam 64. These clearances allow the yoke beam 64 to pivot about the lines of contact between the base walls 76 and the end portions of the yoke beam 64. Those lines of contact define the roll axis 52, which substantially intersects the central longitudinal axis 18 and the pitch axis 62 at, or close to, their point of mutual intersection.

Figure 8:
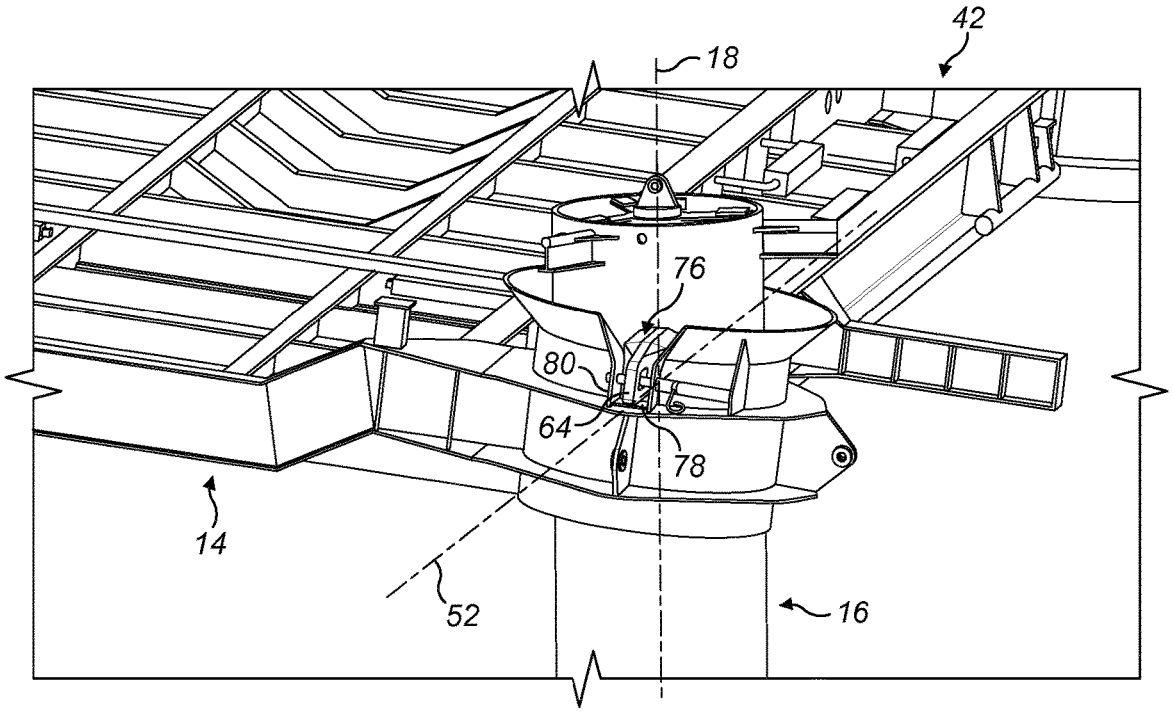
FIGS. 8 and 9 are perspective views of the hybrid foundation of FIG. 4, showing variations in pitch and roll of the mudmat relative to the piles.

The position of the roll axis 52 may best be appreciated with reference to FIG. 8, which shows the mudmat 14 of the subsea foundation 42 adopting a roll angle of 7° about the roll axis 52 with respect to a pile 16. It will be noted here that an end portion of the yoke beam 64 has adopted a corresponding angle with respect to the base wall 76 and side walls 78 of a recess 74 in the pile sleeve 46.

Figure 9:
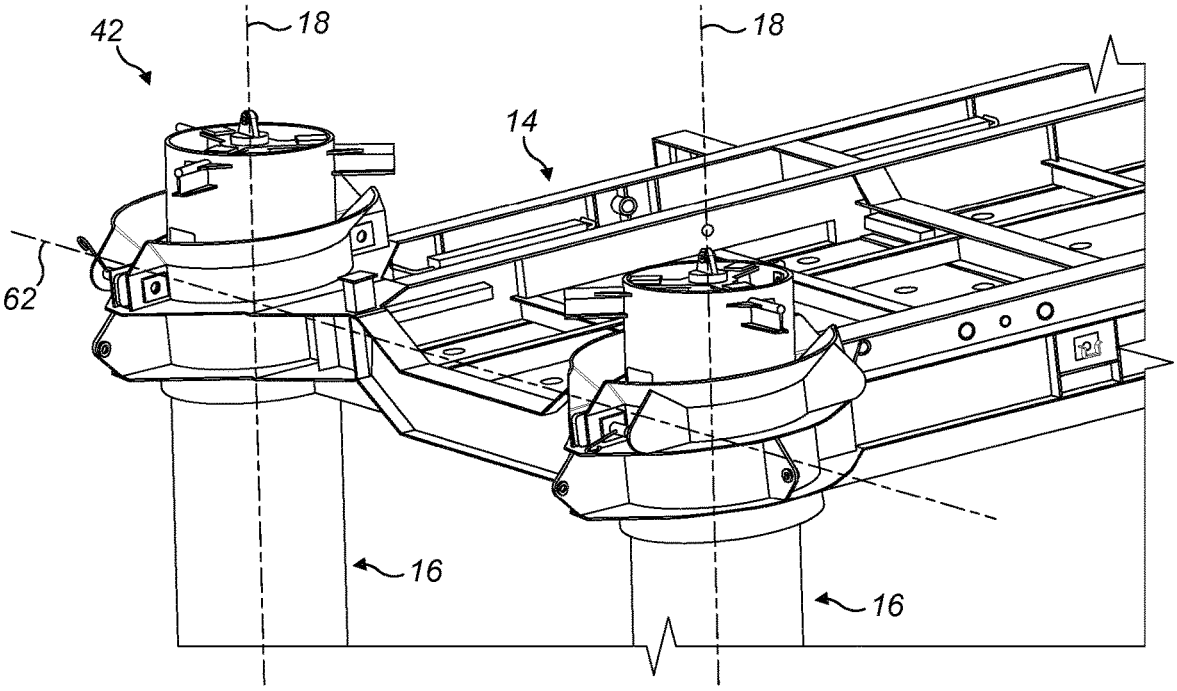

Conversely, FIG. 9 shows the mudmat 14 of the subsea foundation 42 adopting a pitch angle of 7° about the pitch axis 62 with respect to a pile 16. It will be appreciated that this misalignment is accommodated by pivotal movement of the yoke beam 64 about the pitch axis 62 defined by the pivot mounting 60 at the upper end of the rotation block 58, as shown in FIG. 6.

In addition to the embodiments and variants described above, other variations are possible within the inventive concept. For example, the funnel or other guide tube of a guide sleeve used in the first embodiment could be also wedge-shaped like the adaptor ring that is disposed between the guide tube and the mudmat. This combination of cooperating rotary wedges allows a greater range of angular adjustment to accommodate a pile, by turning both the adaptor ring and the guide tube about their respective central axes relative to the mudmat.

Being able to lock piles to shallow foundations in the manner described opens up many possibilities in the future for supporting large PLETs and other subsea structures on sloping seabeds with unfavourable soil conditions, where existing solutions have required huge pre-installed mudmats or suction piles.

The invention claimed is:

1. A subsea foundation for supporting a pipeline or a pipeline accessory, the foundation comprising:

a mudmat;

at least one pile arranged to anchor the mudmat in use by extending with a relative orientation from the mudmat into seabed soil;

a coupling that couples the pile to the mudmat, the coupling comprising at least one interface member supported by the pile for angular displacement relative to the pile and to the mudmat to accommodate the orientation of the mudmat relative to the pile, the pile supporting the interface member in a direction along a central longitudinal axis of the pile; and a roll/pitch pivot member between the pile and the interface member, the roll/pitch pivot member being oriented to permit angular movement of the interface member about a transverse axis substantially orthogonal to the central longitudinal axis of the pile.

2. The foundation of claim 1, wherein the roll/pitch pivot member is located within the pile.

3. The foundation of claim 1, wherein the interface member extends laterally from the pile.

4. The foundation of claim 3, wherein the interface member is a beam that extends through the pile and protrudes radially from apertures in the pile.

5. The foundation of claim 1, wherein the coupling comprises a guide sleeve around the pile, leaving a gap between the pile and the guide sleeve.

6. The foundation of claim 5, wherein the interface member bridges the gap to be received in a receptacle of the guide sleeve.

7. The foundation of claim 6, wherein the receptacle provides clearance around the interface member received therein for angular displacement of the interface member relative to the mudmat.

8. A subsea foundation for supporting a pipeline or a pipeline accessory, the foundation comprising:

mudmat;

at least one pile arranged to anchor the mudmat in use by extending with a relative orientation from the mudmat into seabed soil;

a coupling that couples the pile to the mudmat, the coupling comprising at least one interface member supported by the pile for angular displacement relative to the pile and to the mudmat to accommodate the orientation of the mudmat relative to the pile, the pile supporting the interface member in a direction along a central longitudinal axis of the pile; and a yaw pivot member between the pile and the interface member, the yaw pivot member being oriented to permit angular movement of the interface member about the central longitudinal axis of the pile.

9. The foundation of claim 8, wherein the yaw pivot member is located within the pile.

10. A method of installing a subsea foundation for supporting a pipeline or a pipeline accessory, the method comprising:

installing a mudmat at a seabed location and subsequently anchoring the mudmat by installing at least one pile that extends with a relative orientation from the mudmat into seabed soil and is coupled to the mudmat;

the method further comprising effecting angular displacement of an interface member relative to the mudmat and to the pile to accommodate the orientation of the mudmat relative to the pile, by effecting angular pitch or roll displacement of the interface member about a transverse axis substantially orthogonal to a central longitudinal axis of the pile while the interface member is supported by the pile in a direction along the central longitudinal axis of the pile.

11. The method of claim 10, comprising locking the pile to the mudmat.

12. The method of claim 10, comprising effecting angular yaw displacement of the interface member about the central longitudinal axis of the pile.

13. The method of claim 10, comprising inserting the pile into a guide sleeve of the mudmat, while leaving a gap between the pile and the guide sleeve.

14. The method of claim 13, comprising supporting the pile laterally within the guide sleeve using at least one shim in the gap.

15. The method of claim 10, comprising engaging the interface member with a receptacle as the pile is installed and coupled to the mudmat.

16. The method of claim 15, wherein the interface member enters the receptacle in a downward direction.

* * * * *